US009202393B1

(12) United States Patent
Jones

(10) Patent No.: US 9,202,393 B1
(45) Date of Patent: Dec. 1, 2015

(54) SHELF CHANNEL PRODUCT MARKING SYSTEM AND METHOD

(71) Applicant: Jeffrey A. Jones, Southlake, TX (US)

(72) Inventor: Jeffrey A. Jones, Southlake, TX (US)

( * ) Notice: Subject to any disclaimer, the term of this patent is extended or adjusted under 35 U.S.C. 154(b) by 0 days.

(21) Appl. No.: 14/272,006

(22) Filed: May 7, 2014

(51) Int. Cl.
*B65H 16/00* (2006.01)
*G09F 3/20* (2006.01)
*G09F 3/02* (2006.01)

(52) U.S. Cl.
CPC ..... *G09F 3/204* (2013.01); *B65H 16/005* (2013.01); *G09F 3/02* (2013.01); *B65H 2701/192* (2013.01)

(58) Field of Classification Search
CPC ..... G09F 3/204; B65C 11/00; B65C 9/1892
USPC ..... 221/26, 33, 32
See application file for complete search history.

(56) References Cited

U.S. PATENT DOCUMENTS

| | | | | | |
|---|---|---|---|---|---|
| 333,183 | A | | 12/1885 | Wheeler | |
| 444,106 | A | | 1/1891 | Spraker | |
| 2,023,357 | A | | 7/1935 | Harvey | |
| 2,297,888 | A | | 7/1940 | Heileman | |
| 2,638,211 | A | * | 5/1953 | Spurr | B65D 83/0858 206/449 |
| 2,984,031 | A | | 5/1959 | Giesecke | |
| 3,231,130 | A | * | 1/1966 | Foote | B65D 83/0847 221/131 |
| 3,793,123 | A | * | 2/1974 | Aronson | B65C 11/00 156/719 |
| 3,956,049 | A | | 5/1976 | Johnsen | |
| 4,161,074 | A | | 7/1979 | DePinna | |
| 4,270,774 | A | | 6/1981 | Barnes | |
| 4,527,722 | A | * | 7/1985 | Strachan | B65C 11/00 225/106 |
| 4,818,850 | A | * | 4/1989 | Gombrich et al. | G06K 19/04 235/494 |
| 4,821,918 | A | * | 4/1989 | Turner | B65C 9/1892 156/764 |
| 5,284,689 | A | * | 2/1994 | Laurash et al. | G09F 3/10 283/81 |
| 5,894,923 | A | * | 4/1999 | Hamstra et al. | G09F 3/10 206/232 |
| 6,186,555 | B1 | | 2/2001 | Rawlings | |
| 7,093,999 | B2 | * | 8/2006 | Tucker | B65C 11/00 24/545 |

* cited by examiner

*Primary Examiner* — Timothy Waggoner
(74) *Attorney, Agent, or Firm* — Dan Brown Law Office; Daniel R. Brown

(57) ABSTRACT

A product display marking system for use with product shelves that have plural shelf channels, which receive product markers, and wherein each shelf channel has a channel length. The system includes a bulk product marker that is configured as a continuous strip of material that has a width selected to fit the plural shelf channels, and that has plural tear lines oriented transverse to the continuous length, and which are spaced apart by a strip length that is an integer divisor of the plural channel lengths. One or more strip lengths of the bulk product marker, which are selected to equal a selected one of the plural channel lengths, are selected and torn along one of the plural tear lines, for insertion into the selected one of the plural shelf channels, thereby marking the product disposed thereon.

8 Claims, 4 Drawing Sheets

SHELF CHANNEL PRODUCT MARKING SYSTEM AND METHOD

BACKGROUND OF THE INVENTION

1. Field of the Invention

The present invention relates to product marketing in retail shelf-space presentations. More particularly, the present invention relates to a product marking system that utilizes retail shelf channels for displaying product and brand markers corresponding to products displayed on such shelves.

2. Description of the Related Art

Product presentation and promotion in retail shelve space is a highly competitive field, where all competitors seek consumer attention through presence, branding, and display features. This is readily apparent by simply studying retail product packaging designs and colors. For example, consider snack foods such as candy, snacks, chips, and such. These products are packaged in bright colors with high contrast and dynamic patterns designed to garner consumer attention. Such products are typically displayed on retail shelving, which is an industry in and of itself. Common retail shelf structures include the gondola shelf, the wall shelf, the end cap display, as well as other shelving structures known to those skilled in the art. Retail shelves are typically specified by a shelf width, depth, and height, where the shelf structure has plural individual shelves along its height. Individual shelves have a front edge, which is typically terminated with a shelf channel on its outer edge. The shelf channel is thus located closest to a customer perusing the products displayed on the shelf.

The shelf channel has been used for placement of price information, decoration, and marketing information for many decades because it presents and excellent location to attract the consumer's attention. So much so, that the shelf channel has become a standardized interface, most commonly a 1¼ inch 'C'-channel into which strips of paper, paperboard, cardboard, and polymeric materials imprinted with information and decoration are inserted. These items include price tags, shelf talkers, product and branding information, as well as other printed matter, collectively referred to as product markers. Retailers prefer to maintain all such product markers in a clean, neat, and orderly appearance so as to leave consumers with a favorable impression of the products displayed.

In the retail environment, consumers have access to the products and shelving, so these items are exposed to product turnover, product changes, changing marketing strategies, and the general wear and tear of the consumer retail environment. For these, and other, reasons, product markers placed into shelf channels are frequently changed. Often times, the task of replacing product markers is accomplished by a vendor's representative, who maintains a large amount of shelf space at multiple retail locations. The task of changing product markers in shelf channels is usually secondary to the primary tasks related to maintaining the product inventory disposed on the shelves. Thus it can be appreciated that there is a need in the art for a system and method for efficiently maintaining retail shelf channel product markers that is efficient, neat, orderly, low cost, and that does not overly burden the time and tasks of the individual tending to these activities.

SUMMARY OF THE INVENTION

The need in the art is addressed by the systems and methods of the present disclosure. The present disclosure teaches a retail product display marking system for use in conjunction with product shelves that have plural shelf channels, which receive product markers, and wherein each shelf channel has a channel length that shares a length multiple, which is a lowest common denominator of the plural channels lengths. The system includes a bulk product marker that is configured as a continuous strip of material that has a width selected to fit the plural shelf channels, and that has plural tear lines oriented transverse to the continuous length, and which are spaced apart by a strip length that is an integer divisor of the plural channel lengths. One or more strip lengths of the bulk product marker, which are selected to equal a selected one of the plural channel lengths, are selected and torn along one of the plural tear lines, for insertion into the selected one of the plural shelf channels, thereby marking the product disposed thereon.

In a specific embodiment of the foregoing system, the length multiple of the channel lengths and the strip length are equal to one another. In another specific embodiment, the bulk product marker is imprinted with branding that is repeated every one of the strip lengths.

In a specific embodiment of the foregoing system, the width of the bulk product marker is 1¼ inches, and the strip length is 12 inches. In another specific embodiment, the bulk product marker is fanfold that is creased at the tear lines.

The present disclosure also teaches a retail product display marking system for use in conjunction with product shelves that have plural shelf channels for receiving product markers. The system includes a bulk product marker configured as a continuous strip of material that has a width selected to fit the plural shelf channels, and that has plural tear lines oriented transverse to the continuous length, which are spaced apart by a strip length that is an integer divisor of the plural channel lengths. A dispenser is provided for containing the bulk product marker in a fanfold with creases at a portion of the plural tear lines, and that has an outlet opening through which the bulk product marker is dispensed. One of more strip lengths of the bulk product marker, selected to equal a selected one of the plural channel lengths, are withdrawn through the outlet opening and torn alone one of the plural tear lines, for insertion into the selected one of the plural shelf channels, thereby marking the product disposed thereon.

In a specific embodiment of the foregoing system, the bulk product marker is imprinted with branding that is repeated every one of the strip lengths. In another specific embodiment, the dispenser further includes an access door for inserting the bulk product marker into the dispenser.

In a specific embodiment of the foregoing system, the dispenser further includes a resilient grip disposed about the outlet opening for retaining a leading end of the bulk product marker in a position exterior to the dispenser. In another specific embodiment, the dispenser further includes a dispenser channel on an exterior surface thereof for receiving a single strip length of the bulk product marker, thereby identifying a brand of the bulk product marker.

In a specific embodiment of the foregoing system, the dispenser further includes a mounting tab for attaching the dispenser to a host surface. In a refinement to this embodiment, the mounting tab is positioned to enable plural dispensers to be stacked together, thereby enabling the selection of plural brands of bulk product markers.

The present disclosure also teaches a method of marking retail products displayed on product shelves that have plural shelf channels for receiving product markers, where each shelf channel has a channel length that shares a length multiple, which is lowest common denominator of the plural channels lengths, utilizing a bulk product marker configured as a continuous strip of material that has a width selected to fit the plural shelf channels, and that has plural tear lines oriented transverse to the continuous length, which are spaced apart by a strip length that is an integer divisor of the plural channel lengths. The method includes the steps of selecting a shelf for a particular product, determining a channel length for the selected shelf, and determining that one or more strip lengths of the bulk product marker are equal the channel length. The method further includes tearing the bulk product marker at a tear line corresponding to the determined channel length, thereby obtaining a product marker having a length matching the selected shelf channel length, and inserting the product marker into the selected shelf channel.

In a specific embodiment of the foregoing method, wherein the bulk product marker is disposed within a dispenser and oriented in a fanfold having creases at a portion of the plural tear lines, and that has an outlet opening through which the bulk product marker can be dispensed, the method further includes withdrawing the one or more strip lengths of the bulk product marker through the outlet opening.

DESCRIPTION OF THE INVENTION

Figure 2:
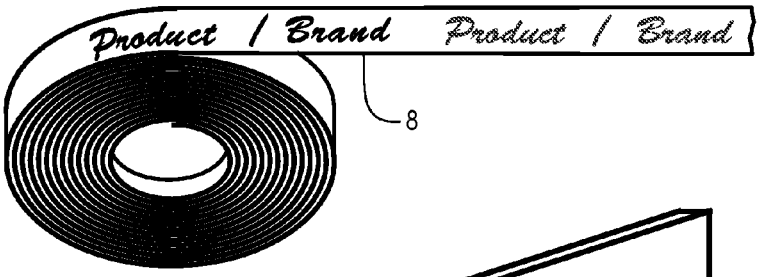
Fig. 2 Prior Art
FIG. 2 is a drawing of a prior art roll of marker strip.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope hereof and additional fields in which the present invention would be of significant utility.

In considering the detailed embodiments of the present invention, it will be observed that the present invention resides primarily in combinations of steps to accomplish various methods or components to form various apparatus and systems. Accordingly, the apparatus and system components, and method steps, have been represented where appropriate by conventional symbols in the drawings, showing only those specific details that are pertinent to understanding the present invention so as not to obscure the disclosure with details that will be readily apparent to those of ordinary skill in the art having the benefit of the disclosures contained herein.

In this disclosure, relational terms such as first and second, top and bottom, upper and lower, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a" does not, without more constraints, preclude the existence of additional identical elements in the process, method, article, or apparatus that comprises the element.

The teachings herein address the problems associated with obtaining a length of product marker that matches a length of shelf channel, which is to be filled for a particular product and brand. For example, a shelf may be three feet long and it may be displaying Brand X snack chips. Thus, the goal is to fill that shelf's channel with a three foot long section of "Brand X/Chips" product marker. In the prior art systems, the approach was to estimate or measure the length, and then cut a section of product marker off of a continuous roll. If this task is done carefully, the results can be satisfactory. However, the primary function of the individual tending to this task is to replenish or change the product displayed on the shelf, and the product marker changing task is secondary in nature. There is also the issue of time management and efficiency, so such individuals may not have the time for accurate measurement and careful cutting of the bulk product marker. The net result is often times a product marker that does not exactly fit the length of the shelf channel and that often times has cut or torn ends that are not straight and square to the length of the shelf channel. In addition, it is preferred that the product and brand imprinted information be centered along the length of the channel, which provides a satisfying balance to the presentation. Failing to center, match length, and provide clean and square end cuts results in a sloppy appearance, and detracts from the essential marketing goal at hand.

Figure 1:
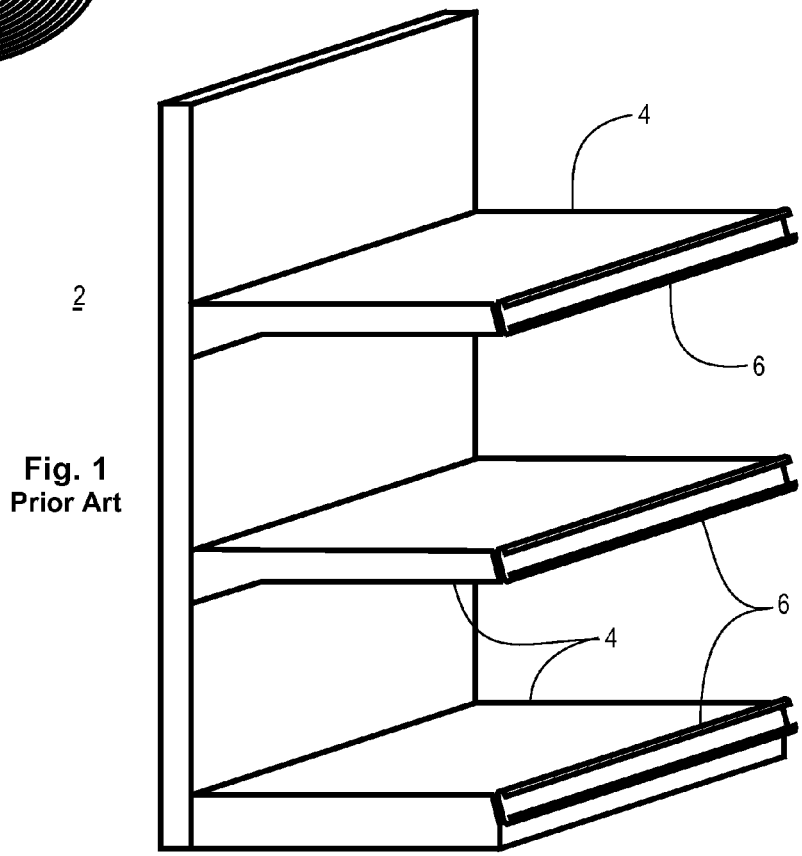
Fig. 1 Prior Art
FIG. 1 is a perspective drawing of a prior art gondola shelf with ticket molding channels on the front edge of each shelf.

Reference is directed to FIG. 1, which is a perspective drawing of a prior art gondola shelf 2 with ticket molding channels 6 on the front edge of each shelf. Hereinafter, the ticket molding channel will be referred to as a shelf channel 6, or simply as a channel. Note that the shelf channels 6 are position of the front edge of the selves 4. This arrangement has been in use for decades and is familiar to those skilled in the art. Similar shelf channel arrangements are provided on most every other type a retail shelving as well, including wall shelves, end caps, and others.

Reference is directed to FIG. 2, which is a drawing of a prior art roll of product marker strip 8. This is also referred to as product marker. Product marker 8 can be fabricated from paper, paperboard, cardboard, or various polymeric materials. Typically, the product marker is imprinted with information or decoration on one side, which is the side that is displayed outwardly when inserted in a shelf channel. The information may be pricing, product information, sales incentives, branding, and other informative or descriptive information. In some applications, the product marker is imprinted with decorative patterns, that are intended to present a pleasing appearance to the consumer. The pattern and information are repeated at regular intervals along the length of the bulk product marker. The spacing of these intervals is typically selected to enable a full cycle of information to appear on the shortest anticipated shelf length. On longer shelves, more than one cycles of information may be presented.

Figure 3:
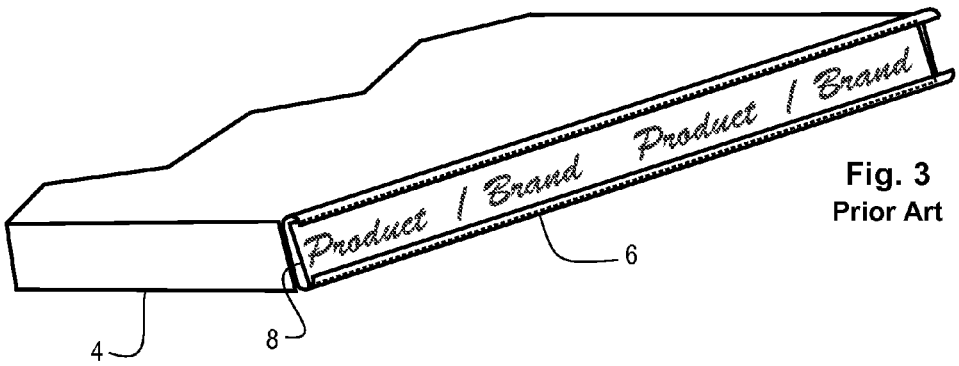
Fig. 3 Prior Art
FIG. 3 is a perspective drawing of a prior art retail shelf showing the front edge having a marker strip inserted into the ticket molding channel.

Reference is directed to FIG. 3, which is a perspective drawing of a prior art retail shelf 4 showing the front edge having a product marker strip 8 inserted into the shelf channel 6. In this example, note the two cycles of the product and brand information are presented.

The present disclosure advances the prior art by teaching a bulk supply of the product marker strip that is perforated with tear lines between the repeating cycles of imprinted information. Also, the information is centered between the tear line locations. The tear lines are oriented perpendicular to the length of the continuous product marker, and are easily torn by hand to provide neat and square ends. Also, the imprinted information will always centered between the tear lines. This enables the individual installing the product markers into the shelf channels to quickly and efficiently accomplish the task and yet provide a neat and orderly appearance to every shelf. It should be noted that commercial retail shelving is commonly manufactured in standardized lengths. Usually with twelve inch increments, so shelves are one foot, two feet, three feet, four feet, and so on, in length. Thus, the tear lines can be spaced at twelve inch intervals, and fit neatly into all of these shelf lengths. Other shelf length standards can also be accommodated. A useful concept is to select a tear line spacing that defines a product marker length that is a least common denominator, or least integer divisor, of the plural shelf lengths that are to be accommodated. In the foregoing example, twelve inches is used.

Figure 4:
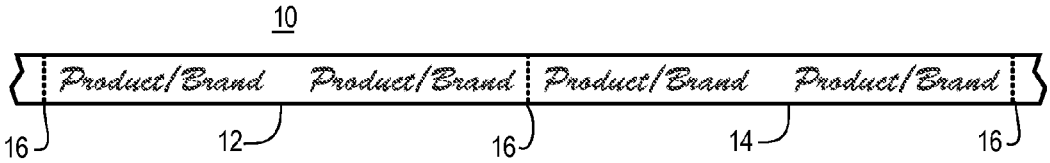
FIG. 4 is a drawing of a section of perforated marker strip according to an illustrative embodiment of the present invention.

Reference is directed to FIG. 4, which is a drawing of a section of perforated marker strip 10 according to an illustrative embodiment of the present invention. In this embodiment, the product marker 10 is imprinted with a "Product/Band" that repeats along its length. The "Product/Brand" is also referred to as a graphic element, which may take on various forms. Tear lines 16 are perforated in the continuous length of product marker 10 to define strip length 12 between the tear lines 16. Note that in this embodiment, the "Product/Brand" information is repeated twice in each strip length 12. Other frequencies of repetition can also be applied. Also note that the "Product/Brand", or graphical element, pattern is centered within each strip length 12.

Figure 5C:
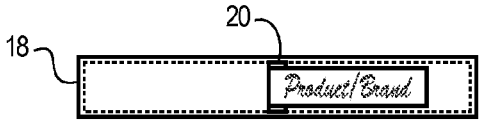
FIGS. 5A, 5B, and 5C are a side view, end view, and top view drawing, respectively, of a marker strip dispenser according to an illustrative embodiment of the present invention.
Figure 5B:
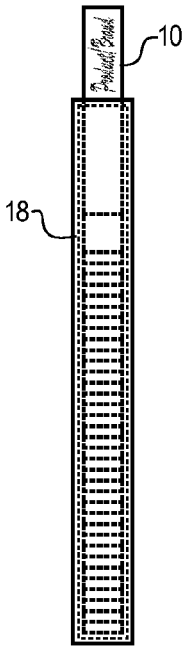
Figure 5A:
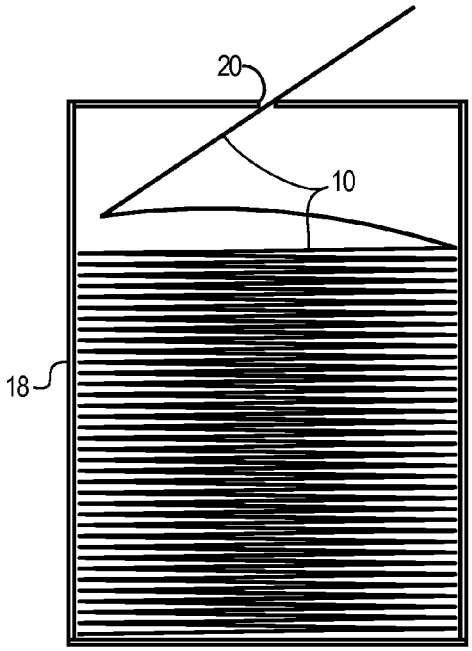

Reference is directed to FIGS. 5A, 5B, and 5C, which are a side view, end view, and top view drawing, respectively, of a product marker strip dispenser 18 according to an illustrative embodiment of the present invention. This embodiment employs a continuous strip of product marker 10 that is arranged in a fanfold with creases at the tear lines. This is a significant improvement over the rolled product marker described hereinbefore. Where the product marker is rolled, it is imprinted with a coiled memory and no longer lies flat when unrolled. As such, it is more difficult to insert into a shelf channel, and is more likely to be damaged as it is inserted into the shelf channel. With the fanfold arrangement, the individual strip lengths lay flat, while each crease yields a flexible hinge joining the individual strip lengths together. Thus, the fanfold product marker is considerably easier to insert into a shelf channel and is less likely to be damaged during the process.

The fanfold of product marker 10 in FIG. 5 is provided within a disposable box enclosure 18, which has an outlet opening 20 at one end. The product marker 10 is withdrawn through the opening 20. The user merely draws out the requisite number of strip lengths, and then tears them free at the corresponding tear line. The box 18 can be fabricated from paperboard of other suitable material, and can be labeled on the outside with the corresponding product and brand information for easy reference. If the user is responsible for a range of products, a corresponding number of different product marker dispenser boxes can be utilized.

Figure 6:
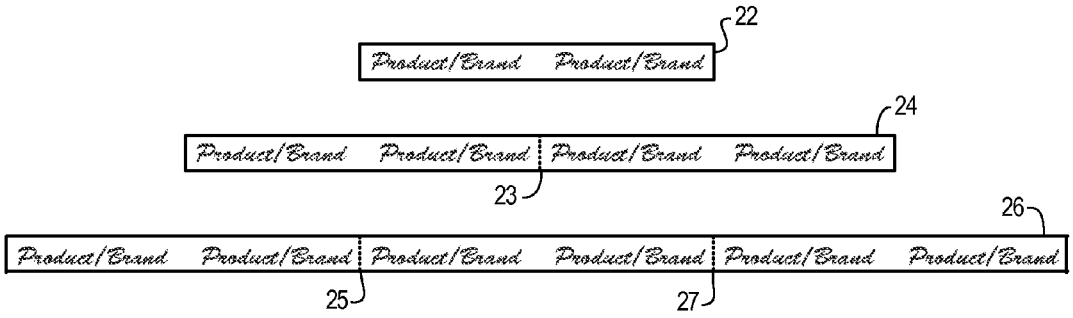
FIG. 6 is a drawing showing plural lengths of marker strip that have been separated at perforations according to an illustrative embodiment of the present invention.

Reference is directed to FIG. 6, which is a drawing showing plural lengths of marker strip 22, 24, 26 that have been separated at perforated tear lines according to an illustrative embodiment of the present invention. In the illustrative embodiment, it is known that standardized shelving widths are at multiples of one foot. Thus, the product marker tear lines are spaced at one foot intervals, and the "Product/Brand" imprinted information is centered between the tear lines. FIG. 6 illustrates a one strip length product marker 22, which is suitable for a one foot wide shelf. Product marker 24 comprises two strip lengths, and has one un-torn tear line 23 along its length, and this is suitable for a two foot long shelf. Product marker 26 comprises three strip lengths, and has two un-torn tear lines 25, 27 along its length, and this is suitable for a two foot long shelf. Thus it can be appreciate that the product marker is suitable for any shelf width that is an integer multiple of one foot. In fact, of the user encounters a shelf that is not an integer multiple of one foot, the requisite length can be cut from the fanfold in the customary fashion.

Figure 7:
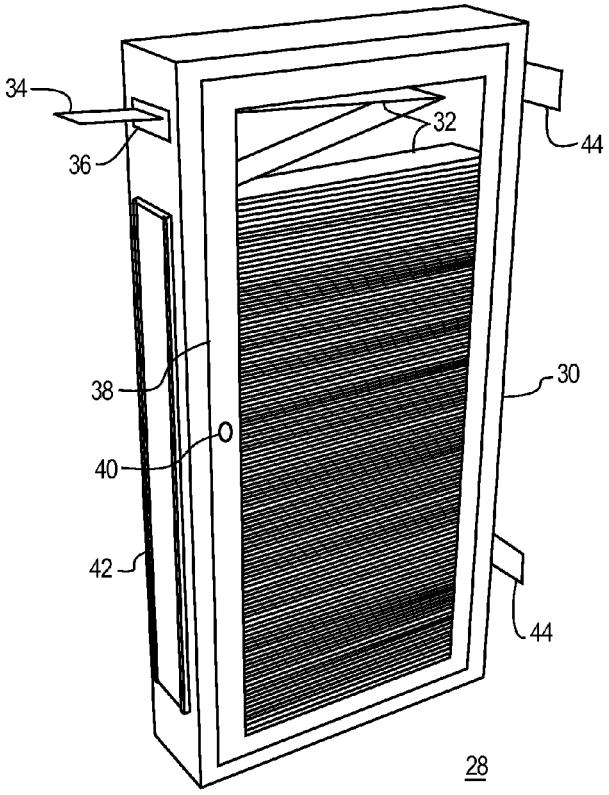
FIG. 7 is a perspective view drawing of a marker strip dispenser according to an illustrative embodiment of the present invention.

Reference is directed to FIG. 7, which is a perspective view drawing of a product marker strip dispenser 30 according to an illustrative embodiment of the present invention. This embodiment presents a refillable dispenser 30 for the product marker of the illustrative embodiment. A fanfold of continuous product marker 32 is contained within a dispenser enclosure 30. An outlet opening 36, which also comprises an elastomeric resilient grip, is provided so that a free end 34 of the fanfold 32 is retained on the exterior of the enclosure 30. The opening and grip combination 36 provide sufficient force to prevent the free end 34 from sliding back into the enclosure 30, yet allows the user to pull a desired number of strip lengths out prior to tearing them free. A door 38 is provided on the side of the enclosure 30, which facilitates replenishment of the fanfold 32 as it is consumed. A door latch 40 is provided to secure the door 38. A section of channel 42 is provided on the front of the enclosure 30 so that the user can insert a strip of product marker therein to assist in identifying which product and brand is available for dispensing from the dispensing container 30. A pair of offset tabs 44 are provided so that the dispenser 30 can be mounted to a stable surface. The tabs 44 are offset so that plural dispensers can be stacked together.

Figure 8:
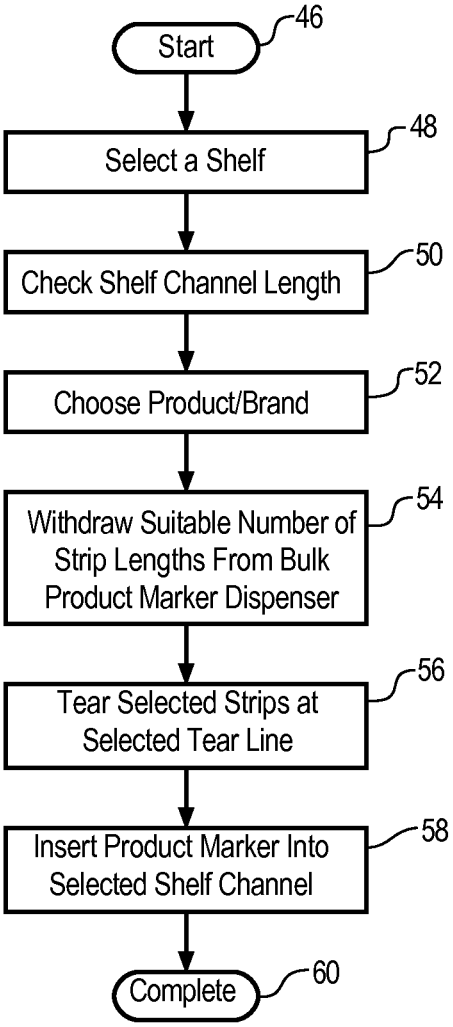
FIG. 8 is a process flow diagram according to an illustrative embodiment of the present invention.

Reference is directed to FIG. 8, which is a process flow diagram according to an illustrative embodiment of the present invention. A user of the illustrative embodiment will typically operate from a service vehicle and manage plural products and brands. The vehicle travels from retail location to retail location and services shelf space with plural shelves of the plural brands. As each shelf is serviced, the product marker may need to be replaced. This process begins at step 46 and proceeds to step 48 where the user decides on a shelf to service. At step 50, the user checks the shelf length, which is generally readily apparent since the increments of one-foot widths are fairly obvious to an experienced user. At step 52, the user selects a product/band for the shelf, and at step 54, the user withdraws a suitable number of strip lengths from the bulk dispenser for that product/brand. At step 56, the user tears the selected number of strip lengths at the appropriate tear line. At step 58 the product marker is inserted into the shelf, which completes the process at step 60.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A retail product display marking system for use in conjunction with product shelves having plural shelf channels for receiving product markers, the system comprising:

a bulk product marker configured as a continuous strip of material having a width selected to fit the plural shelf channels, and having plural tear lines oriented transverse to said continuous length, which are spaced apart by a strip length that is an integer divisor of the plural channel lengths;

a dispenser for containing said bulk product marker in a fanfold with creases at a portion of said plural tear lines, and having an outlet opening through which said bulk product marker is dispensed, and wherein one of more strip lengths of said bulk product marker, selected to equal a selected one of the plural channel lengths, are withdrawn through said outlet opening and torn alone one of said plural tear lines, for insertion into the selected one of the plural shelf channels, thereby marking the product disposed thereon.

2. The system of claim 1, and wherein:

said bulk product marker is imprinted with branding that is repeated every one of said strip lengths.

3. The system of claim 1, and wherein said dispenser further comprises:

an access door for inserting said bulk product marker into said dispenser.

4. The system of claim 1, and wherein said dispenser further comprises:

a resilient grip disposed about said outlet opening for retaining a leading end of said bulk product marker in a position exterior to said dispenser.

5. The system of claim 1, and wherein said dispenser further comprises:

a dispenser channel on an exterior surface thereof for receiving a single strip length of said bulk product marker, thereby identifying a brand of said bulk product marker.

6. The system of claim 1, and wherein said dispenser further comprises:

a mounting tab for attaching said dispenser to a host surface.

7. The system of claim 6, and wherein:

said mounting tab is positioned to enable plural dispensers to be stacked together, thereby enabling the selection of plural brands of bulk product markers.

8. The system of claim 1, and wherein:

a graphic element is centered between two adjacent tear lines on said strip length.

* * * * *